US005720698A

United States Patent [19]

Dalebout et al.

[11] Patent Number: 5,720,698

[45] Date of Patent: Feb. 24, 1998

[54] STRIDING EXERCISER

[75] Inventors: William T. Dalebout, North Logan; Mark LeBeau, Logan, both of Utah

[73] Assignee: Icon Health & Fitness, Inc., Logan, Utah

[21] Appl. No.: 657,632

[22] Filed: May 30, 1996

Related U.S. Application Data

[63] Continuation-in-part of Ser. No. 54,016, May 6, 1996.

[51] Int. Cl.[6] ..... A63B 22/00

[52] U.S. Cl. ..... 482/52; 482/51

[58] Field of Search ..... 482/51, 52, 70, 482/71, 79, 114, 95

[56] References Cited

U.S. PATENT DOCUMENTS

| | | | |
|---|---|---|---|
| D. 373,393 | 9/1996 | Montijo et al. | D21/191 |
| 4,826,152 | 5/1989 | Lo | 482/114 X |
| 4,850,585 | 7/1989 | Dalebout | 272/70 |
| 4,940,233 | 7/1990 | Bull et al. | 272/130 |
| 5,000,443 | 3/1991 | Dalebout et al. | 482/52 X |
| 5,263,910 | 11/1993 | Yang | 482/52 |
| 5,419,747 | 5/1995 | Piaget et al. | 482/51 |
| 5,496,235 | 3/1996 | Stevens | 482/51 |
| 5,505,678 | 4/1996 | Johnston | 482/52 |
| 5,507,709 | 4/1996 | Wu | 482/95 X |
| 5,584,780 | 12/1996 | Lin | 482/51 |
| 5,584,781 | 12/1996 | Chen | 482/52 X |
| 5,603,675 | 2/1997 | Wu | 482/52 |
| 5,620,400 | 4/1997 | Foster | 482/52 X |

OTHER PUBLICATIONS

Marcy® Cross Trainer Product Literature, upon information and belief, published prior to the filing date of the above referenced application.

The Reebok Sky Walker Product Literature, upon information and belief, published prior to the filing date of the above referenced application.

Weslo® Air Walker® Owner's Manual, 1993.

Pro–Form Air Walker Electronic Ergometer Product Literature, 1989/1990.

Pro–Form Air Walker Product Literature, 1992.

Pro–Form 520 ZI Zero Impact Product Literature, 1993.

Marcy® Cross Trainer Product Literature, 1989.

The Reebok Sky Walker Product Literature, 1995.

*Primary Examiner*—Richard J. Apley
*Assistant Examiner*—Denise Pothier
*Attorney, Agent, or Firm*—Workman, Nydegger & Seeley

[57] ABSTRACT

A no-impact striding exercise machine having a lever for coupling first and second elongate members, such that rotation of the first elongate member causes the lever to pivot about an axis perpendicular to longitudinal axis of the lever, causing the second elongate member to rotate in a direction opposite the rotation of the first elongate member.

28 Claims, 7 Drawing Sheets

STRIDING EXERCISER

RELATED APPLICATION

This patent application is a Continuation-in-Part of Copending Design patent application Ser. No. 29/054,016 filed on May 6, 1996 and entitled "Striding Exerciser."

BACKGROUND OF THE INVENTION

1. The Field of the Invention

This invention is in the field of exercise machines which allow a user to stimulate a reciprocating, striding motion while suspending the user above a surface. Specifically, this invention relates to a no-impact striding exercise machine having a means for coupling first and second suspension means, such that rotation of the first suspension means causes the coupling means to pivot linearly, causing the second suspension means to rotate in a direction opposite the rotation of the first suspension means.

2. Background

In light of the intense modern desire to increase aerobic activity, exercises including jogging and walking have become very popular. Medical science has demonstrated the improved strength, health, and enjoyment of life which results from physical activity.

Despite the modern desire to improve health and increase cardiovascular efficiency, modern lifestyles often fail to readily accommodate accessible running areas. In addition, weather and other environmental factors may cause individuals to remain indoors as opposed to engaging in outdoor physical activity.

Moreover, experience in treating exercise-related injuries has demonstrated that a variety of negative effects accompany normal jogging. Exercise-related knee damage, for example, often results in surgery or physical therapy. Joints are often strained when joggers run on uneven surfaces or change direction. Other examples of common injuries resulting from jogging, particularly on uneven terrain, include foot sores, pulled muscles, strained tendons, back injuries, and head injuries.

In addition, it is desirable to exercise lower body muscle groups, while at the same time exercising upper body muscle groups, thus achieving a total body workout. As a result, exercise machines have been marketed which allow a user to simulate the natural motions of walking and jogging, yet provide an environment in which the physical activity can occur in a limited space and with a decreased amount of impact. Such machines may include leg members which suspend the user above a surface and handle members for gripping by the user. Furthermore, the machines may include synchronizing mechanisms for synchronizing the movement of opposing handle and leg members.

However, while the concept of simulating a striding motion in an exercise machine has been actively pursued in recent years, exercise machines attempting to achieve this striding capability often employ a variety of complex moving parts. Complex components are not only expensive and often more difficult to manufacture, but are often more difficult to use and may even decrease the smoothness and non-impact gliding ability of the exercise machine. Complex moving parts may be subject to increased wear, requiring additional upkeep and repair.

For example, synchronizing mechanisms should translate rotation smoothly from one set of leg and handle members to another, creating a smooth non-impact striding motion, and preventing wear on parts. Certain synchronizing mechanisms, however, incur undesired torsional strain within the mechanisms in order to synchronize the movement of the handle and leg members.

SUMMARY AND OBJECTS OF THE INVENTION

It is therefore an object of the present invention to provide an exercise strider employing a linearly pivoting coupling mechanism which allows a user to simulate the striding movements of a walker or jogger in a limited amount of space.

It is another object of the present invention to provide such simulation employing parts which are simple and relatively inexpensive to manufacture.

It is another object of the present invention to combine reduced-injury, minimal space capability with total body workout capability in an exercise machine.

It is another object of the present invention to provide a striding exercise machine having a means for coupling first and second suspension means, such that rotation of the first suspension means causes the coupling means to pivot linearly, causing the second suspension means to rotate in a direction opposite the rotation of the first suspension means.

It is an additional object of the present invention to provide an exercise strider which provides a no impact workout.

This invention is a no-impact striding exercise machine having a means for coupling first and second elongate members. A user mounts the exercise machine by stepping into foot supports associated with each elongate member. The user then engages in a reciprocating, striding motion. Movement of either elongate member causes it to rotate about one side of a frame. This rotation in turn causes the coupling means to pivot linearly, causing rotation of the other elongate member in an opposite direction of rotation. Thus, the movement of the two different elongate members is synchronized and smooth.

Hubs rotatably attached to each side of the frame suspend each elongate member above a surface. A resistance means such as a knob may be mounted on each hub to selectively compress a sleeve between a tapering cylinder which rotates with the elongate member and a stationary cylindrical housing mounted on the frame. This compression creates resistance to the rotation of the respective elongate member, resulting in a more challenging striding motion for the user. Overrotation of each elongate member may be prevented by stops located strategically on the frame. The preferred frame is essentially Z-shaped on first and second sides, which are connected by upper and lower cross beams. The upper cross beam may include upper and lower plates between which a coupling beam is pivotally mounted. Upon rotation of either elongate member, the coupling beam preferably pivots linearly about an axis located in the center of the beam, causing the other elongate member to rotate in an opposite direction.

An advantage of this linear translation of rotation from one elongate member to another is the simple design available to translate the rotation. Translation of rotation is achieved by the linear pivot of the coupling beam back and forth in a reciprocating fashion. Another advantage is that few moving parts are employed, resulting in efficient manufacturing potential. In addition, because the translation is linear, as opposed to torsional, wear on parts is decreased, as is overall strain within the mechanism. Finally, the coupling means is readily responsive to slight movements of either elongate member.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENT

This specification discloses an exercise machine for suspending a user above a surface while the user engages in a reciprocating, striding motion. The machine is comprised of first and second suspension means, a frame for maintaining the first and second suspension means above a surface, the first and second suspension means rotatably mounted to the frame, and means for coupling the first and second suspension means. Rotation of the first suspension means causes the coupling means to pivot linearly, rotating the second suspension means in a direction opposite the direction of the first suspension means.

Figure 1:
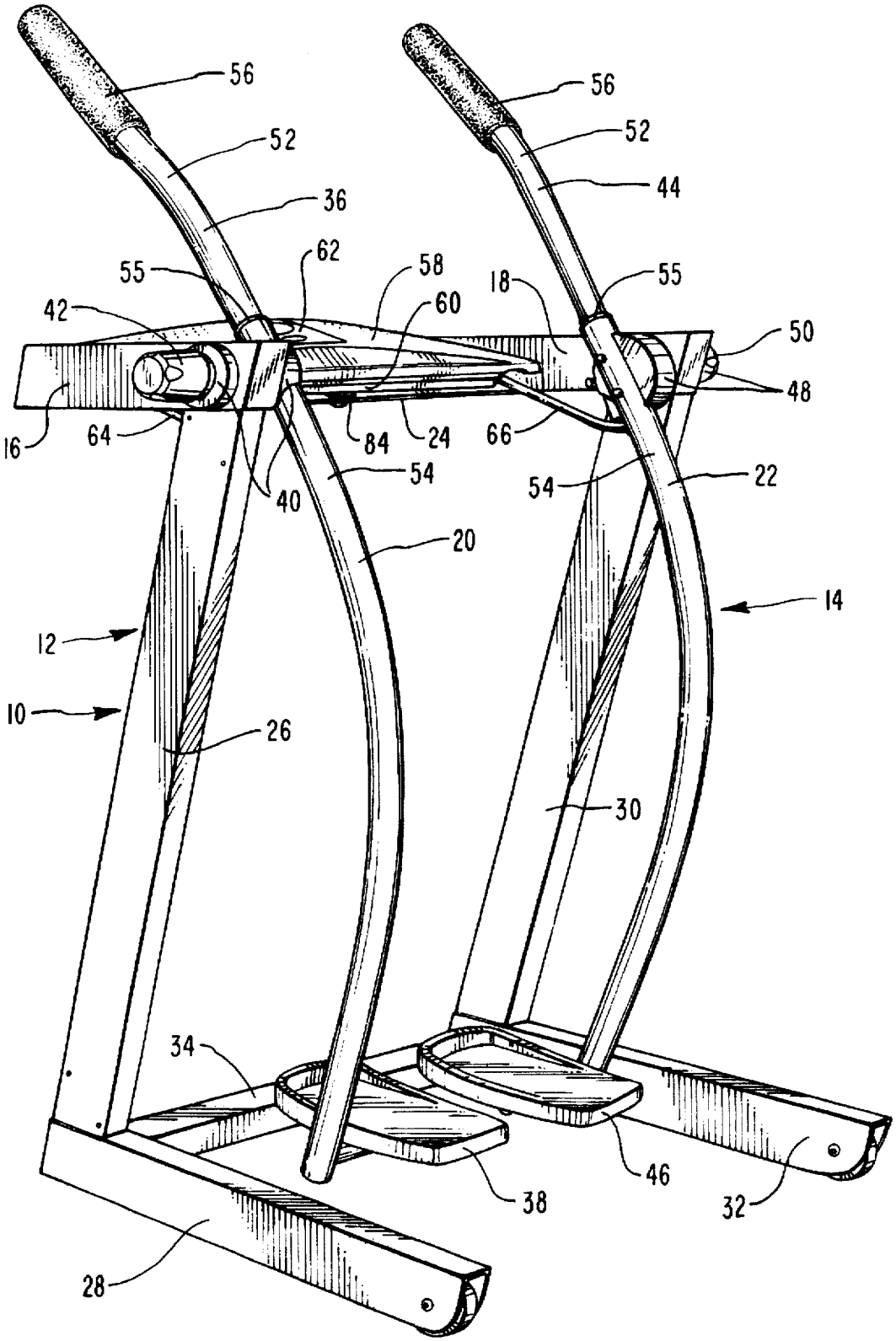
FIG. 1 is a perspective view of the invention.
Figure 2:
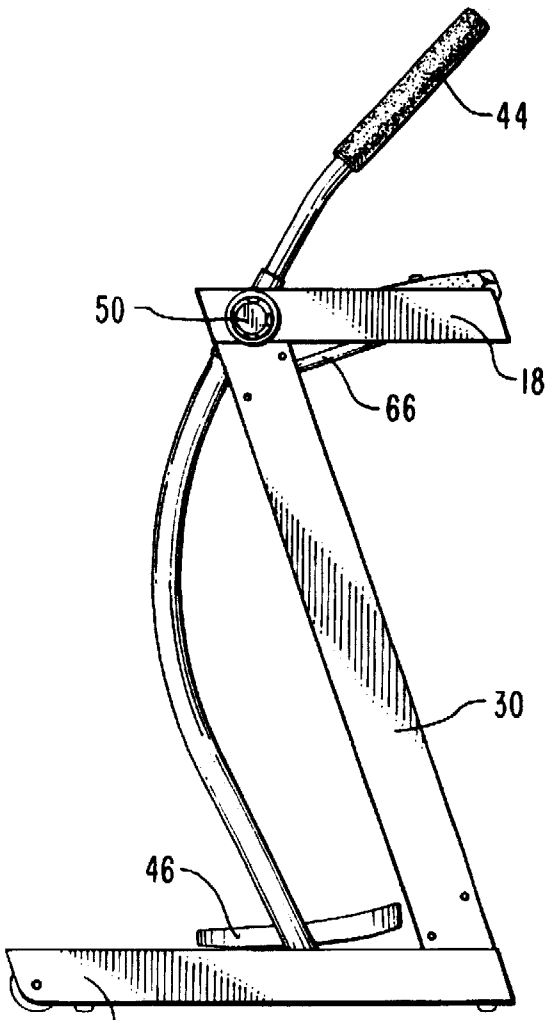
FIG. 2 is a side view of the invention.

Turning now to FIGS. 1 and 2, the exercise machine of the present invention may be comprised of a frame 10 having a first Z-shaped side 12 and second Z-shaped side 14. By way of example, a first upper frame member 16 and a second upper frame member 18 support a first elongate member 20 and a second elongate member 22, respectively. As shown in detail in FIG. 7, a third upper frame member 24 may be mounted between distal portions of the first and second upper frame members.

Returning now to FIG. 1, a first diagonal member 26 is disclosed connecting a proximal end of the first upper frame member 16 to a distal end of a first lower frame member 28. Similarly, a second diagonal member 30 may connect a proximal end of the second upper frame member 18 to a distal end of a second lower frame member 32. In this embodiment, a third lower frame member 34 exists between distal ends of the first lower frame member 28 and the second lower frame member 32.

Figure 3:
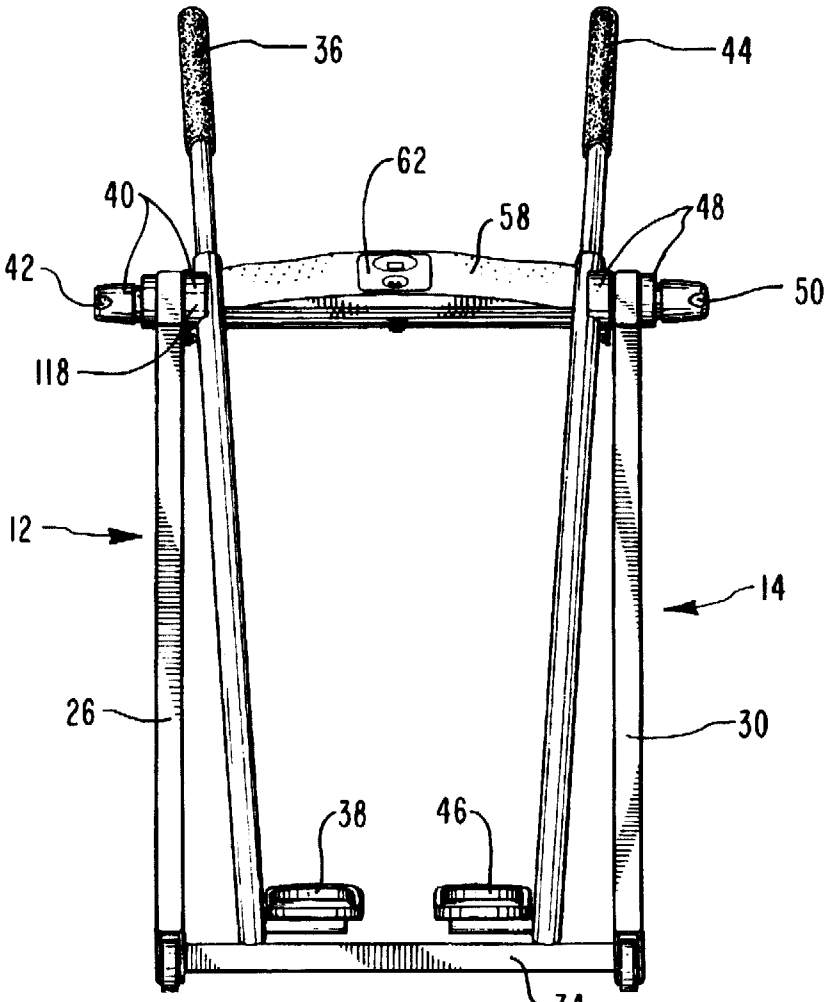
FIG. 3 is a rear view of the invention.

As shown in FIGS. 1 and 3, the first and second sides 12, 14 are spaced such that the frame 10 can support the first and second elongate members 20, 22 above a surface. As shown in FIG. 2, wheels may be provided at the proximal ends of the first and second lower frame members 28, 32 for rolling the exercise machine to a desired location. As further shown in FIG. 2, rubber stops may also be placed under the first and second lower frame members 28, 32.

One skilled in the art will recognize that a variety of frame styles are possible and that the main purpose of the frame 10 is to support the suspension means and coupling means above a surface such that the user can engage in a simulated striding, reciprocating motion.

With reference now to FIGS. 1 and 3 in the preferred embodiment, the first suspension means is comprised of a first elongate member 20, the first elongate member 20 having a first handle 36. The preferred first suspension means further includes a first foot support 38 disposed on the first elongate member 20. In addition, the first suspension means may include a hub means, such as first hub 40 which is rotatably mounted to the frame 10 and is attached to the first elongate member 20 so that the first elongate member 20 rotates about the frame 10. As shown in FIG. 1, the first hub 40 may include a first knob 42 for selectively increasing the resistance of the first hub 40, and therefore the first elongate member 20, against rotation.

Similarly, in the preferred embodiment, the second suspension means is comprised of a second elongate member 22, the second elongate member 22 having a second handle 44. The second suspension means further includes a second foot support 46 disposed on the second elongate member 22. In addition, the second suspension means may include a hub means, such as second hub 48 which is rotatably mounted to the frame 10 and is attached to the second elongate member 22 so that the second elongate member 22 rotates about the frame 10. The second hub 48 may include a second knob 50 for selectively increasing the resistance of the second hub 48 against rotation.

Thus, a user can operate the machine by maintaining one foot in the first foot support 38 and another in the second foot support 46 and, by gripping the first handle 36 and the second handle 44, then rotating the suspension means in a reciprocating, striding motion.

The first and second elongate members 20, 22 may each be comprised of single elongate tube which is contoured as shown in FIGS. 1–3 such that a user has space in an upper body region for upper body movement, yet has closer foot supports, 38, 46 the proximity of which may allow the user to maintain the user's balance more readily during striding. Each elongate member may also be comprised of an upper elongate tube 52 which fits through a sleeve 55 and into a lower elongate tube 54 and is covered by a foam grip 56.

One skilled in the art will recognize that a variety of foot supports are possible, however, the disclosed pedal-like supports, 38, 46 are particularly useful in that a distal concave foot surface is provided, thus allowing the user to put pressure against the distal wall to propel the user's leg forward. This capability is particularly useful in light of the gliding motion desired. The motion is an arcuate, reciprocating, striding motion which is preferably a no-impact experience for the user. The linear synchronization of the first and second elongate members 20, 22 allows for an improved gliding, striding motion.

As further shown in FIGS. 1 and 3, a console 58 is preferably disposed above the third upper frame member 24. In part, the console 58 acts cosmetically, essentially covering the coupling beam 60 and the third upper frame member 24, shown in detail in FIG. 7. As demonstrated in FIG. 6, the console 58 may include a plurality of beveled surfaces 59 for placement of the hands during use. The console 58 may also include a monitor 62 to provide the user feedback relating to repetitions, speed, and other factors.

Figure 4:
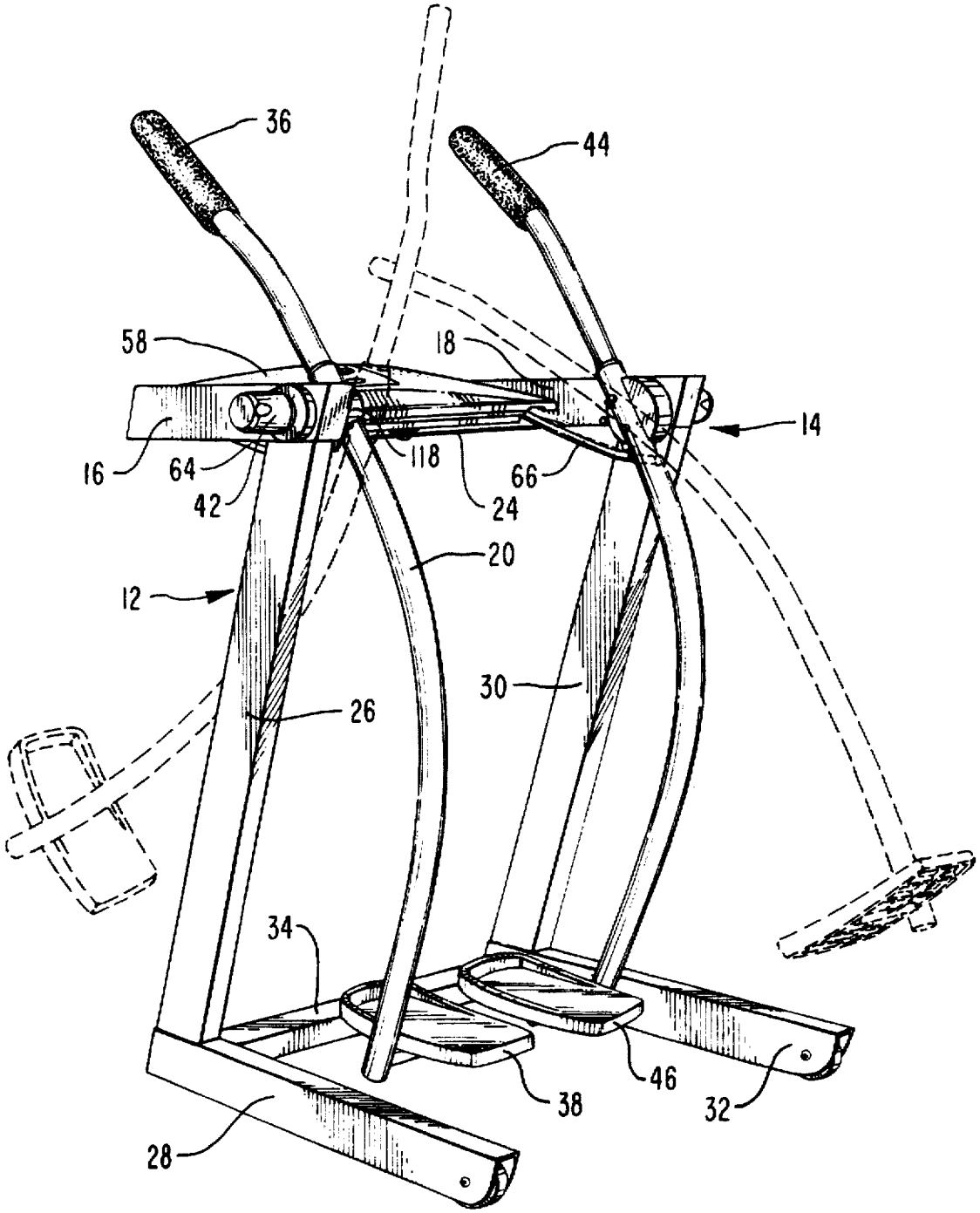
FIG. 4 is a perspective view of the invention demonstrating, in phantom lines, the first and second suspension means in an opposed position.
Figure 5:
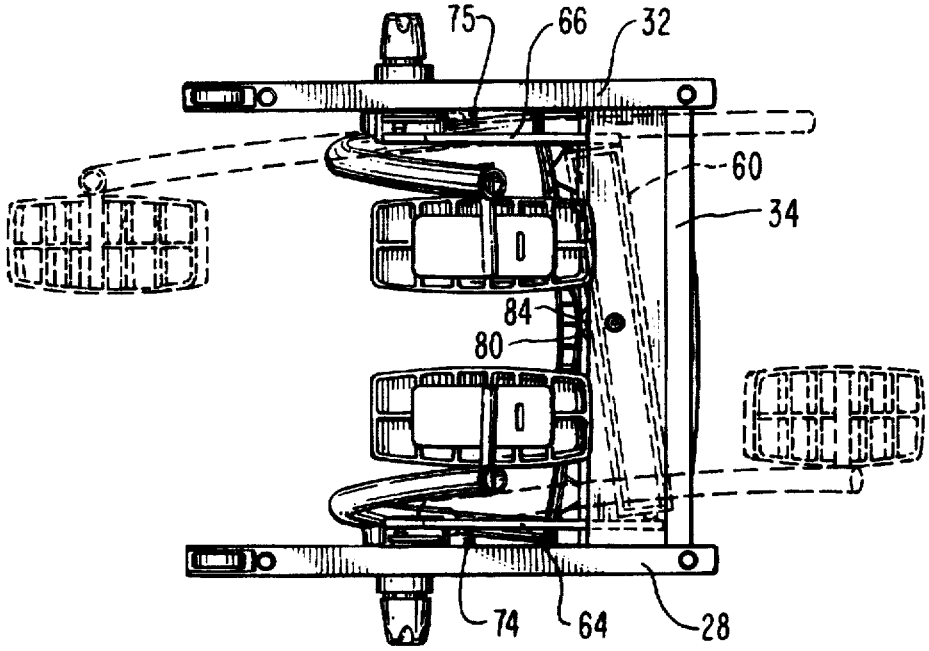
FIG. 5 is a bottom view of the invention of FIG. 4, demonstrating in phantom lines the preferred coupling beam.

FIGS. 4 and 5 demonstrate the coupling action of the coupling beam 60 occurring upon use of the machine. As shown in the shadow lines of FIG. 4, as the first elongate member 20 is rotated in one direction, the second elongate member 22 is rotated in an opposing direction. The coupling beam 60 and its associated connectors ensure this synchronization. As shown in FIG. 5, a bottom view of the opposing action of FIG. 4, the coupling beam 60 (shown in shadow lines) pivots linearly upon the rotation of either elongate member, translating rotation from one elongate member into rotation of the other elongate member in the opposite direction.

Figure 7:
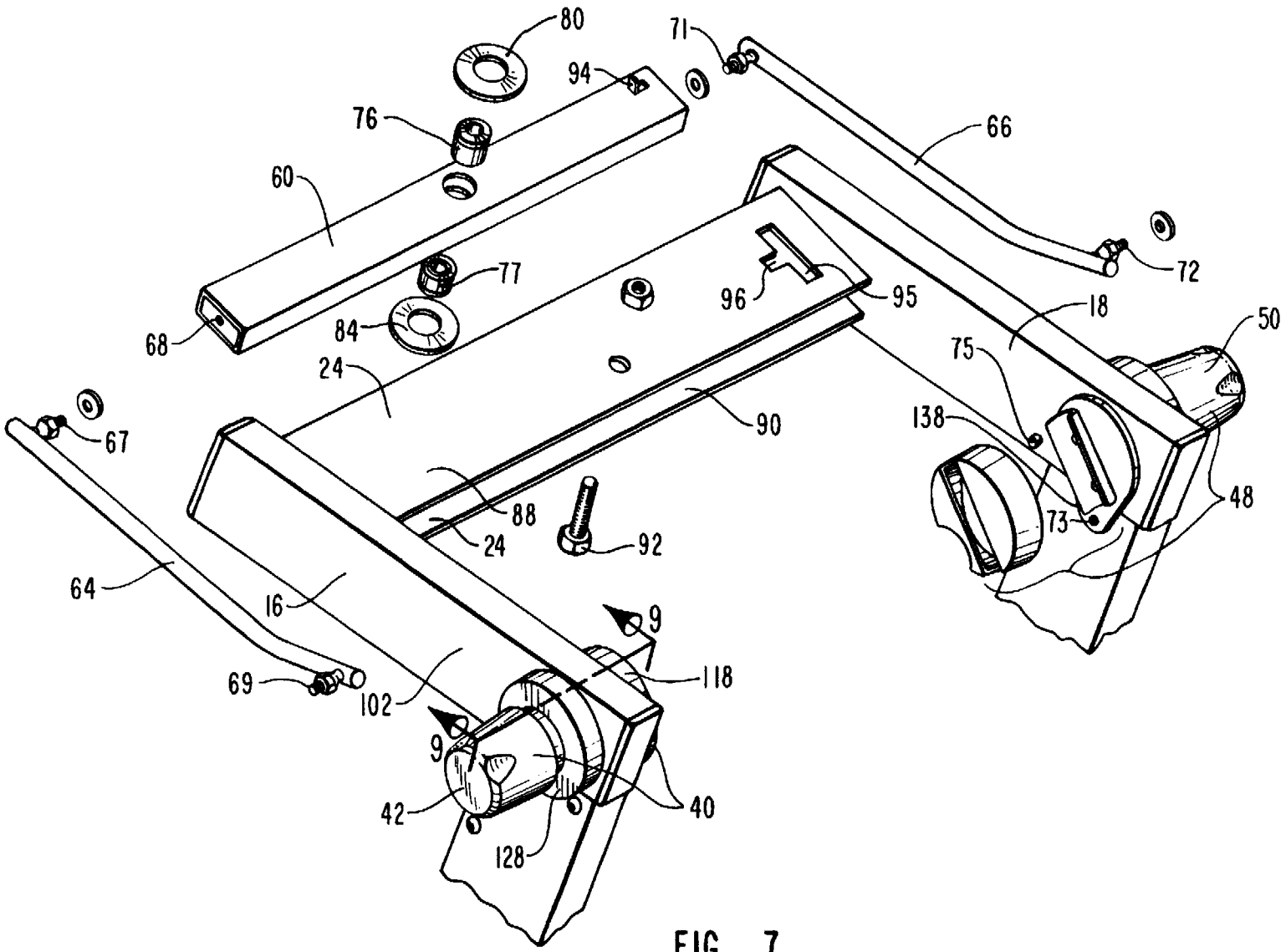
FIG. 7 is an exploded view of the coupling beam and connecting link arms and the upper frame portion of the present invention, including the U-shaped housing into which the coupling beam is preferably disposed. The first and second hubs are also shown.

As further shown in exploded view in FIG. 7, the coupling beam 60 is preferably linked to the first hub 40 and the second hub 48 through the use of a first link arm 64 and a second link arm 66, respectively. The first link arm 64 and the second link arm 66 each contain two ball-jointed threads, the first distal threads 67 connecting to first receiving threads 68 on the coupling beam 60 and the first proximal threads 69 connecting to the first receiving threads 70, shown in FIG. 10, within the first hub 40. Similarly, with reference again to FIG. 7, the second distal threads 71 connect to the second receiving threads (not shown) on the coupling beam 60 and the second proximal threads 72 connect to the second receiving threads 73 within the second hub 48.

Figure 8:
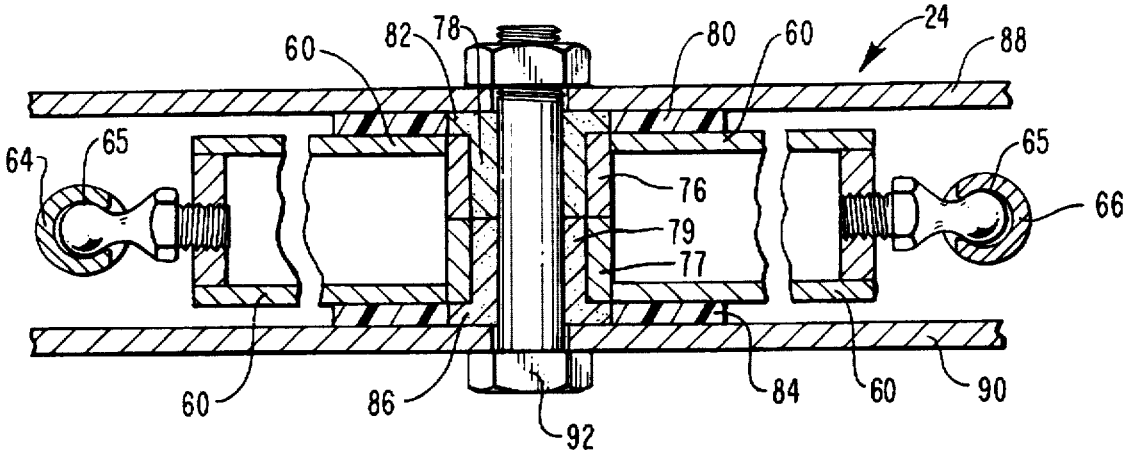
FIG. 8 is a cross-sectional view of the preferred method for pivotally mounting the coupling beam within the U-shaped housing.

The ball joints 65, preferably lubricated, are shown in cross section in FIG. 8. The use of ball-jointed threads ensures that the pivot action of the coupling beam 60 is linear, despite the circular rotation of the first and second hubs 40, 48. Thus, as the first and second hubs 40, 48 rotate, their respective first and second link arms 64, 66 translate the rotational motion of hubs 40, 48 into linear motion by the coupling beam 60.

Figure 6:
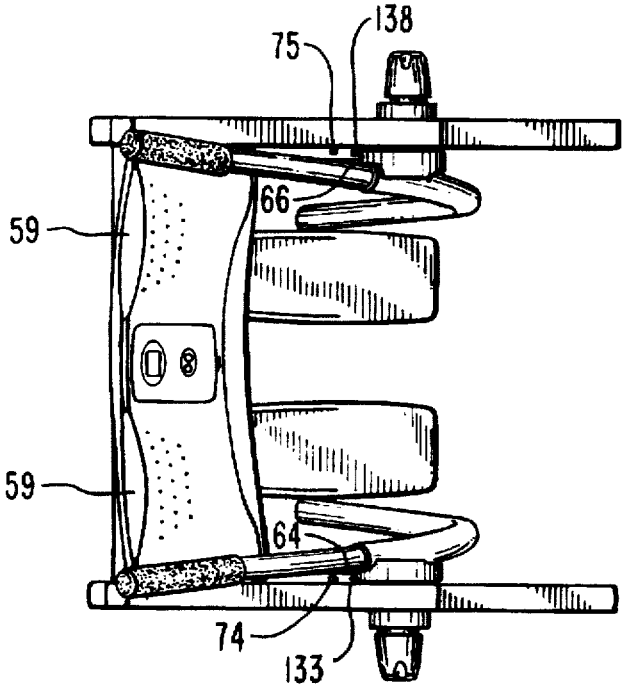
FIG. 6 is a top view of the invention.

The first and second link arms 64, 66 and third upper frame member 24 may be angled as shown in FIG. 7 so that the first and second link arms 64, 66 avoid entanglement with their respective rotating first and second hubs 40, 48. As shown in FIGS. 5, 6, and 7, the proximal portions of the first and second link arms 64, 66 feature outwardly-oriented jointed threads 69, 72 connected to their respective first and second hubs 40, 48, such that the first and second link arms 64, 66 may be placed inward from respective first and second over-extension prevention knobs 74, 75 on the frame 10 to avoid contacting the knobs 74, 75 during rotation.

As shown in FIGS. 7 and 8, the coupling beam 60 is preferably pivotally mounted to the third upper frame member 24 through the use of an upper pivot sleeve 76 and a lower pivot sleeve 77 welded within the beam 60. Each sleeve 76, 77 contains a corresponding pivot bushing 78, 79, preferably made of brass, which fits inside in a tight fitting fashion. A rim of each bushing flares out of each sleeve 78, 79 such that the outer diameter of the flared rim is approximately the same or slightly larger or smaller than the outer diameter of the sleeve 78, 79.

An upper washer 80 concentric with the flared bushing rim 82 of the upper pivot sleeve 76 and a lower washer 84 concentric with the flared bushing rim 86 of the lower pivot sleeve 77 assist in maintaining the linear movement of the coupling beam 60, preventing the coupling beam 60 from rubbing against the upper plate 88 and the lower plate 90 of the U-shaped third upper flame member 24 such that vertical movement of the coupling beam 60 is minimized.

By pivoting the coupling beam 60 about the bolt 92, the coupling beam 60 maintains a balanced center of gravity. It is also apparent from the foregoing that the first and second link arms 64, 66 serve as means for translating rotational movement of the first and second hub means into linear movement of the coupling beam 60. The upper washer 80 and the lower washer 84 assist the first and second link arms 64, 66, further minimizing vertical displacement of the coupling beam 60.

As further demonstrated in FIG. 7, a tab 94 may protrude from the coupling beam 60 and through the T-shaped aperture 95 in the third upper member 24 for oscillation through a magnetic circuit passage (not shown) within the console 58. A magnetic circuit may exist in the console comprised of a reed switch and a magnet spaced from the reed switch. As the steel tab 94 travels back and forth through the passage between the reed switch and the magnet, the magnetic field is broken. Thus, the action of the tab 94 travelling back and forth through the passage activates the monitor 62 to indicate, for example, the number of strides made by the user. A magnetic concentrator, such as a metal cylinder somewhat larger than the magnet, may be disposed behind the magnet to assist in focusing the magnetization. The portion 96 of the T-shaped aperture 95 through which the tab 94 does not pass, which is under the reed switch, is designed to minimize interference within the magnetic circuit caused by excess steel in the region.

The components of the first hub 40 and the components surrounding the first hub 40 will now be discussed in more detail referring to FIGS. 7, 9, and 10.

Figure 9:
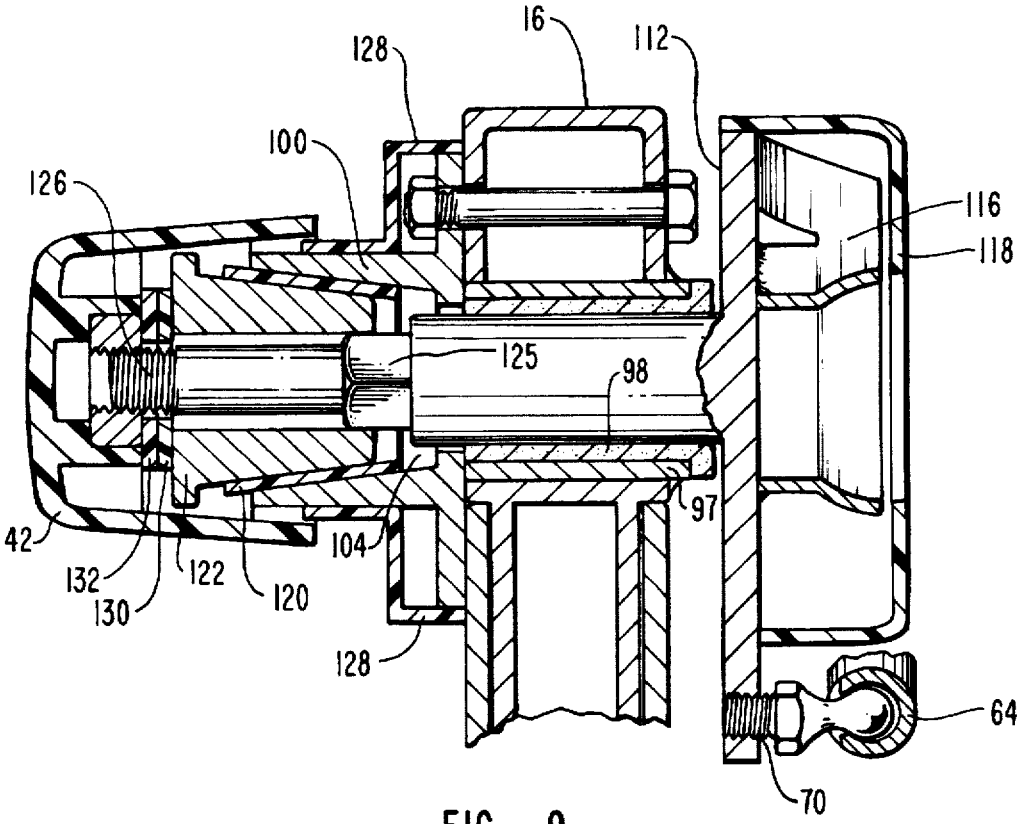
FIG. 9 is a cross-sectional view of an upper frame member and a cylindrical housing, and the preferred hub assembly rotatably mounted thereon.
Figure 10:
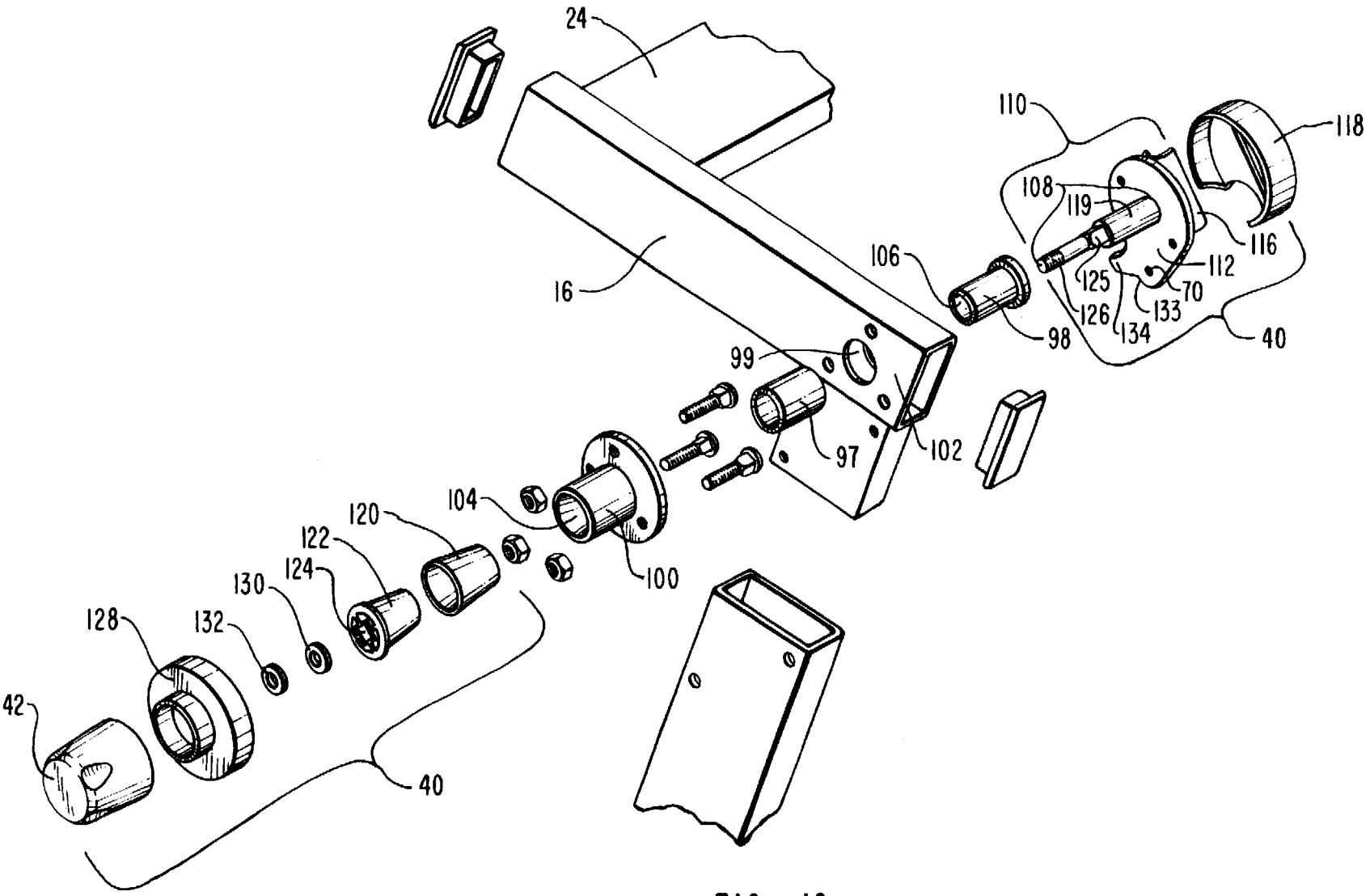
FIG. 10 is an exploded view demonstrating the relationship of an upper frame member and a cylindrical housing, and a preferred hub assembly rotatably mounted thereon.

As shown in FIGS. 9 and 10, a first frame sleeve 97 having a first frame sleeve bushing 98 disposed therein is preferably disposed within frame aperture 99 in the proximal end of the first upper frame member 16 such that the first hub 40 may rotate within the bushing 98. The outer diameter at the flared rim of the first frame sleeve bushing 98 is approximately the same or slightly larger or smaller than the outer diameter of the first frame sleeve 97.

A first cylindrical housing 100 is disposed against an outer portion 102 of the first side 12 of the frame such that a hole 104 in the first cylindrical housing 100 is in communication with a hole 106 in the first frame sleeve bushing 98. Thus, a spindle 108 from a first pivot bracket 110 may be disposed initially through the first frame sleeve bushing 98, and further through the first cylindrical housing 100.

With continued referred to FIGS. 9 and 10, the first pivot bracket 110 is comprised of a first pivot bracket plate 112, which is disposed against the first frame sleeve bushing 98. A first pivot bracket saddle 116 is disposed on an inner portion of the first pivot bracket plate 112 for retention of the first elongate member 20. A first pivot bracket cover 118 may be placed between the saddle 116 and the first elongate member 20. A cylindrical portion 119 of the first pivot bracket spindle 108 is disposed within the first frame sleeve bushing 98 and is the point of rotation for the first hub 40.

After the first pivot bracket spindle 108 is disposed through the first frame sleeve bushing 98 and through the first cylindrical housing 100, a first resistance sleeve 120 may be slidably mounted between the first cylindrical housing 100 and a first tapering cylinder 122, preferably having a first square bore 124 which slidably receives the square portion 125 of the first pivot bracket spindle 108. By being mounted on the first pivot bracket spindle 108 in this fashion, the first tapering cylinder 122 rotates in synchronization with the first elongate member 20. A first knob 42 having first receiving threads (not shown) for the first pivot bracket spindle threads 126 is provided for compressing the first resistance sleeve 120 between the tapering cylinder 122 and the cylindrical housing 100, thus increasing the resistance of the overall first hub 40 to rotation. While the first cylindrical housing 100 may have an untapered inner surface, in one embodiment, the surface is tapered as shown in FIG. 9, such that the drafts of the first cylindrical housing 100, first resistance sleeve 120 and first tapering cylinder 122 are the same.

Thus, the first knob 42 is threadedly disposed on an end of the first pivot bracket spindle 108 for selectively compressing the first tapering cylinder 122, first resistance sleeve 120, and first cylindrical housing 100 together, thereby increasing the resistance of the first hub 40 to movement of the first elongate member 20. By employing a threaded resistance knob such as the fast knob 42, the user may selectively adjust the resistance of the exercise machine by screwing or unscrewing the first knob 42.

As further shown in FIG. 9, a hub cover 128 may be provided. In one embodiment, a nylon washer 130 neighbors the tapering cylinder 122 and is next to a Delrin washer 132. In another embodiment, a thrust washer may be disposed against the tapering cylinder 122 which may then have a thrust bearing disposed against it, against which a second thrust washer is disposed, against which a plastic washer is disposed.

In the preferred embodiment, the Delrin employed in the first resistance sleeve 120 is a white Delrin because of the mating surfaces and intense frictional application involved, whereas the upper and lower washers 80, 84, shown in FIGS. 7 and 8, preferably comprise carbon-black Delrin. In the tapering cylinder 122 and the cylindrical housing 100 it is preferred to employ a die-east aluminum with a 30 to 60 microinch finish.

Preferably, the second hub 48 and the components surrounding the second hub 48 are mirror images of the first hub 40. Thus, the first and second hub means each comprise resistance means for selectively increasing resistance on the rotation of the respective first and second suspension means, each resistance means comprising a threadable knob for selectively compressing a sleeve between a cylindrical housing mounted on an outer portion of the frame and a tapering cylinder rotating in synchronization with the respective suspension means.

As shown in FIGS. 5, 6, and 7, first and second over-extension prevention knobs 74, 75, such as cylindrical or tear-shaped protuberances, exist on the lower inner portion of the first and second upper frame members 16, 18. As a handle of the first elongate member 20 is pulled further away from the console 58, the rim 133 of the tear-shaped first pivot bracket 110 (shown in FIG. 10) eventually contacts the first over-extension prevention knob 74. This contact prevents further extension of both the first and second elongate members 20, 22. Similarly, as a handle of the second elongate member 22 is pulled away from the console 58, the second pivot bracket rim 138 (shown in FIG. 7) contacts the second over-extension prevention knob 75 preventing further extension of the first and second elongate members 20, 22.

The over-extension prevention knobs 74, 75 thus act as safety means whereby the user is prevented from over-extending during use of the machine and whereby the handle is prevented from contacting the console 58. Preferably, the handle stops approximately 1 to 2 inches before contacting the console 58.

As shown in FIG. 10, it is possible to place a protuberance 134 on the rim 133 of a pivot bracket such that the protuberance 134 will contact an over-extension prevention knob, or such that contact will be made in the corner between the protuberance 134 and the rim 133.

The over-extension prevention knobs 74, 75 are preferably placed such that each elongate member is allowed to rotate in an approximate 70° arc. From the neutral position disclosed in FIG. 1, each elongate member is allowed to rotate in an approximate 35° are in a rear direction and in an approximate 35° are in a forward direction.

Since the rotation of the first and second elongate members 20, 22 is coupled, as the rotation of either elongate member is ended by an over-extension prevention knob, the rotation of the other elongate member, the handle of which will preferably be near the console, also ceases. One skilled in the art will recognize that each over-extension prevention knob thus comprises a means for preventing the over-extension of the first and second elongate members, over-extension defined as rotation of a hub beyond a desired point.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An exercise machine for suspending a user above a surface while the user engages in a reciprocating, striding motion, comprising:

first and second suspension means;

a frame for supporting the first and second suspension means above the surface, the first and second suspension means rotatably mounted to the frame; and means for coupling the first and second suspension means, the coupling means including a lever having a first end pivotally coupled to the first suspension means and a second end pivotally coupled to the second suspension means, wherein rotation of the first suspension means causes the lever to pivot about an axis located between the first and second ends of the lever, thereby rotating the second suspension means in a direction opposite the rotation of the first suspension means.

2. An exercise machine as in claim 1, wherein the coupling means further comprises:

a first link arm pivotally connecting the first suspension means to the first end of the lever, the first link arm having one end pivotally coupled to the first suspension means and an opposing end pivotally coupled to the first end of the lever; and a second link arm pivotally connecting the second suspension means to the second end of the lever, the second link arm having one end pivotally coupled to the second suspension means and an opposing end pivotally coupled to the second end of the lever.

3. An exercise machine as in claim 1, wherein the first and second suspension means comprise first and second elongate members, respectively, each elongate member including a handle portion and a foot support.

4. An exercise machine as in claim 3, wherein each elongate member has a tubular shape and is contoured such that a user has space in the upper body region for upper body movement, and in the lower body region for movement of the feet.

5. An exercise machine as in claim 3, wherein the first and second suspension means further comprise first and second hub means, respectively, mounted on first and second sides of the frame, respectively, wherein the first and second elongate members are attached to the first and second hub means, respectively.

6. An exercise machine as in claim 5, wherein the first and second hub means each comprise resistance means for selectively increasing resistance on the rotation of the respective first and second suspension means, each resistance means comprising a threadable knob for selectively compressing a sleeve between a cylindrical housing mounted on an outer portion of the frame and a tapering cylinder rotating in synchronization with the respective suspension means.

7. An exercise machine as in claim 1, wherein the frame is further comprised of:

first and second upper frame members; and a third upper frame member mounted between distal portions of the first and second upper frame members.

8. An exercise machine as in claim 1, wherein the lever includes a middle portion located between the first and second ends of the lever, and wherein the middle portion of the lever is pivotally coupled to the frame.

9. An exercise machine as in claim 1, wherein the axis about which the lever pivots is perpendicular to a longitudinal axis of the lever.

10. An exercise machine for suspending a user above a surface while the user engages in a reciprocating, striding motion, comprising:

first and second elongate members, each elongate member having a first end and a second end;

first and second foot supports coupled to the second ends of the first and second elongate members, respectively;

a frame for maintaining the first and second elongate members above the surface, the first and second elongate members being rotatably mounted to the frame; and a beam mounted to the frame such that the beam pivots about an axis perpendicular to a longitudinal axis of the beam;

the beam being pivotally coupled to the first and second elongate members such that movement of the first elongate member causes the beam to pivot, rotating the second elongate member in a direction opposite the rotation of the first elongate member.

11. An exercise machine as in claim 10, wherein first and second hub means rotatably mount the first and second elongate members, respectively, to the frame; and wherein the first and second hub means each comprise resistance means for selectively increasing resistance on the rotation of the respective first and second suspension means, each resistance means comprising a threadable knob for selectively compressing a sleeve between a cylindrical housing mounted on an outer portion of the flame and a tapering cylinder rotating in synchronization with the respective suspension means.

12. An exercise machine as in claim 10, wherein the first elongate member is pivotally coupled to a first end of the beam and the second elongate member is pivotally coupled to a second end of the beam.

13. An exercise machine as in claim 10, wherein first and second hub means rotatably mount the first and second elongate members, respectively, to the frame.

14. An exercise machine as in claim 10, wherein the frame comprises:

first and second upper frame members; and a third upper frame member mounted between the first and second upper frame members.

15. An exercise machine as in claim 14, wherein the frame further comprises:

first and second lower frame members;

a third lower frame member mounted between the distal portions of the first and second lower frame members; and first and second diagonal members extending from proximal ends of the first and second upper flame members, respectively, and intersecting distal ends of the first and second lower frame members, respectively.

16. An exercise machine as in claim 10, wherein a first link arm is pivotally coupled to a first end of the beam and the first elongated member and a second link arm is pivotally coupled to a second end of the beam and the second elongate member.

17. An exercise machine as in claim 10, wherein first and second hub means rotatably mount the first and second elongate members, respectively, to the frame; and first and second link arms pivotally connect the first and second hub means, respectively, to first and second ends of the beam.

18. An exercise machine for suspending a user above a surface while the user engages in a reciprocating, striding motion, comprising:

first and second elongate members, each elongate member having a handle portion and a foot support;

a frame for maintaining the first and second elongate members above the surface, the first and second elongate members being rotatably mounted to the frame;

a beam mounted to the frame such that the beam pivots about an axis perpendicular to a longitudinal axis of the beam; and means for translating rotational movement of the first and second elongate members into pivotal movement of the beam such that the movement of the first elongate member causes the beam to pivot thereby rotating the second elongate member in a direction opposite the rotation of the first elongate member.

19. An exercise machine as in claim 18, wherein first and second hub means rotatably mount the first and second elongate members, respectively, to the frame.

20. An exercise machine as in claim 19, wherein a first cylindrical housing is disposed on an outer portion of a first side of the frame and wherein the first and second hub means each comprise a pivot bracket having a plate with a saddle on an inner portion of the plate for retention of the elongate member; and a spindle on an outer portion of the plate disposed through the frame and the cylindrical housing;

a tapering cylinder slidably disposed about the spindle;

a cylindrical sleeve slidably mounted between the housing and the tapering cylinder;

a knob threadedly disposed on an end of the spindle for selectively compressing the tapering cylinder, sleeve, and housing together, thereby increasing the resistance of the hub means to movement of the elongate member.

21. An exercise machine as in claim 19, wherein the means for translating rotational movement of the first and second elongated members into pivotal movement of the beam comprises first and second link arms pivotally connecting the first and second hub means, respectively, to first and second ends of the beam, respectively.

22. An exercise machine as in claim 21, wherein the first link arm has one end pivotally coupled to the first hub means and an opposing end pivotally coupled to the first end of the beam; and wherein the second link arm has one end pivotally coupled to the second hub means and an opposing end pivotally coupled to the second end of the beam.

23. An exercise machine as in claim 19, further comprising means for preventing the overextension of the first and second elongate members.

24. An exercise machine as in claim 18, wherein the frame comprises:

first and second upper frame members;

a third upper frame member mounted between the first and second upper frame members;

first and second lower frame members;

a third lower frame member mounted between the distal portions of the first and second lower frame members; and first and second diagonal members extending from proximal ends of the first and second upper frame members, respectively, and intersecting distal ends of the first and second lower frame members, respectively.

25. An exercise machine as in claim 18, wherein the means for translating rotational movement of the first and second elongate members into pivotal movement of the beam comprises first and second link arms pivotally coupling the first and second elongate members, respectfully, to first and second ends of the beam, respectfully.

26. An exercise machine as in claim 25, wherein the first and second link arms each comprise proximal and distal bail-jointed threads.

27. An exercise machine as in claim 25, wherein the first link arm has one end pivotally coupled to the first elongate member and an opposing end pivotally coupled to the first end of the beam; and wherein the second link arm has one end pivotally coupled to the second elongate member and an opposing end pivotally coupled to the second end of the beam.

28. An exercise machine for suspending a user above a surface while the user engages in a reciprocating, striding motion, comprising:

first and second elongate members, each elongate member having a first end and a second end;

first and second foot supports coupled to the second ends of the first and second elongate members, respectively;

a frame for maintaining the first and second elongate members above the surface;

first and second hub means for rotatably mounting the first and second elongate members, respectively, to the frame;

a beam mounted to the flame such that the beam pivots about an axis perpendicular to a longitudinal axis of the beam; and first and second link arms pivotally connecting the first and second hub means, respectively, to first and second ends of the beam, respectively, such that movement of the first elongate member causes the beam to pivot, rotating the second elongate member in a direction opposite the rotation of the first elongate member.

* * * * *

UNITED STATES PATENT AND TRADEMARK OFFICE

CERTIFICATE OF CORRECTION

PATENT NO. : 5,720,698

DATED : Feb. 24, 1998

INVENTOR(S) : William T. Dalebout; Mark LeBeau

It is certified that error appears in the above-identified patent and that said Letters Patent is hereby corrected as shown below:

Col. 1, line 12, after 'to" change "stimulate" to --simulate--

Col. 2, line 22, after "linearly" insert --, that is about an axis located between the ends of the coupling means,--

Col. 3, line 54, after "linearly" insert --, that is about an axis located between the ends of the coupling means,--

Col. 6, line 7, after "upper" change "flame" to --frame--

Col. 6, line 55, after "continued" change "referrred" to --reference--

Col. 7, line 23, before "knob" change "fast" to --first--

Col. 7, line 41, after "die-" change "east" to --cast--

Col. 9, line 65, after "the" change "flame" to --frame--

Col. 10, line 20, after "upper" change "flame" to --frame--

Col. 10, line 25, after "first" change "elongated" to --elongate--

Col. 10, line 49, after "pivot" insert a comma

Col. 11, line 5, after "second" change "elongated" to --elongate--

Col. 12, line 1, after "members," change "respectfully" to --respectively--

UNITED STATES PATENT AND TRADEMARK OFFICE

CERTIFICATE OF CORRECTION

PATENT NO. : 5,720,698

DATED : Feb. 24, 1998

INVENTOR(S) : William T. Dalebout; Mark LeBeau

It is certified that error appears in the above-identified patent and that said Letters Patent is hereby corrected as shown below:

Col. 12, line 2, after "beam," change "respectfully" to --respectively--

Col. 12, line 5, before "-jointed" change "bail" to --ball--

Col. 12, line 26, before "such" change "flame" to --frame--

Signed and Sealed this

Fifth Day of January, 1999

*Attest:*

*Attesting Officer*

*Acting Commissioner of Patents and Trademarks*